United States Patent [19]

Thompson

[11] 4,098,227

[45] Jul. 4, 1978

[54] BIASED FLEXIBLE ELECTRODE TRANSFER

[75] Inventor: Robert L. Thompson, Webster, N.Y.

[73] Assignee: Xerox Corporation, Stamford, Conn.

[21] Appl. No.: 819,633

[22] Filed: Jul. 27, 1977

[51] Int. Cl.[2] ..... G03G 15/06

[52] U.S. Cl. ..... 118/649; 118/647

[58] Field of Search ..... 118/647, 649, 648

[56] References Cited

U.S. PATENT DOCUMENTS

| | | | |
|---|---|---|---|
| 3,169,886 | 2/1965 | Simm | 118/649 |
| 3,376,852 | 4/1968 | Weiler | 118/647 |
| 3,672,330 | 6/1972 | Sato et al. | 118/647 |
| 3,696,784 | 10/1972 | Benson | 118/647 |
| 3,783,826 | 1/1974 | Urbanek | 118/647 X |
| 3,817,212 | 6/1974 | Fukushima | 118/648 |
| 4,050,804 | 9/1977 | Silverberg | 118/661 X |

*Primary Examiner*—Mervin Stein
*Assistant Examiner*—Andrew M. Falik

[57] ABSTRACT

A system for transferring charged toner in an electrostatic printing apparatus from a photoreceptive drum to a paper web comprises a flexible dielectric belt tensioned across the surface of the drum and having an integral flexible electrode facing the paper web which is located between the dielectric belt and the photoreceptive drum. The electrode is biased by a power supply such that the toner particles are forced by an electrostatic field away from the drum and onto the paper web. Additional flexible electrodes are used to control the electric fields at the leading and trailing edges of the zone of contact between the paper web and the drum.

11 Claims, 4 Drawing Figures

BIASED FLEXIBLE ELECTRODE TRANSFER

BACKGROUND OF THE INVENTION

This invention relates to xerographic printing systems and, more particularly, to improved apparatus for transferring toner from a photoreceptive drum to a paper web.

In xerographic copying and printing systems a drum having a photoreceptive surface is electrostatically charged with an image of the document to be reproduced. An electrostatic toner is distributed on the drum and arranged by the electrostatic charge to form a physical image corresponding to the document image. In the systems in which this invention finds special utility, the toner is then transferred from the photoreceptive surface of the drum to a paper web. To complete this transfer, the electrostatic attraction of the toner to the drum must be overcome.

The well known technique for accomplishing the toner transfer consists of creating an electrostatic charge on the side of the paper opposite from the drum having a polarity and at such a level that the toner particles are attracted away from the drum and onto the paper. Heretofore, this field has been produced by a corotron by means of a corona discharge. Such a system has several disadvantages including the need for a very high voltage supply, nonuniformities in the electrostatic field produced by the corona, ozone generation and significant manufacturing and service cost. Thus, there exists a need for a simpler and more effective transfer system.

The present invention accomplishes the toner transfer through the use of a flexible electrode which is in contact with the paper web and in very close proximity to the photoreceptive drum. The electrode establishes an electrostatic field which attracts the toner particles to achieve the transfer from the drum to the paper. This system uses a lower voltage supply, has a uniform electrostatic field, generates no ozone and is easy to fabricate and maintain.

Flexible electrodes can also be spaced near the leading and trailing edges of the contact zone between the paper and the photoreceptive drum to control the electrostatic fields present in these regions. These electrodes minimize the electrostatic field and related charge exchange which takes place when the paper makes and breaks contact with the drum.

SUMMARY OF THE INVENTION

In accordance with the present invention, there is provided apparatus for effecting the transfer of toner from a photoreceptive drum to a paper web in a xerographic printing system. The apparatus comprises a pair of rollers adjacent to the photoreceptive drum having a dielectric belt tensioned between the rollers with the belt being deflected by the drum. A flexible electrode is attached to the dielectric belt and extends across substantially the full axial length of the drum in a direction generally perpendicular to the process direction. The electrode is disposed between the dielectric belt and the paper web, and the paper web travels between the electrode and the drum. A power supply biases the electrode at a level and with an appropriate polarity to urge transfer of the electrostatically charged toner from the drum to the paper web.

In accordance with another feature of the present invention, a pair of flexible electrodes is provided on a dielectric belt which is tensioned between two rollers and deflected by the photoreceptive drum. The electrodes are biased in relation to the drum to provide a control field that minimizes the exchange of static charges which tends to occur when the paper web makes and breaks contact with the drum.

DETAILED DESCRIPTION OF THE EMBODIMENT

Figure 1:
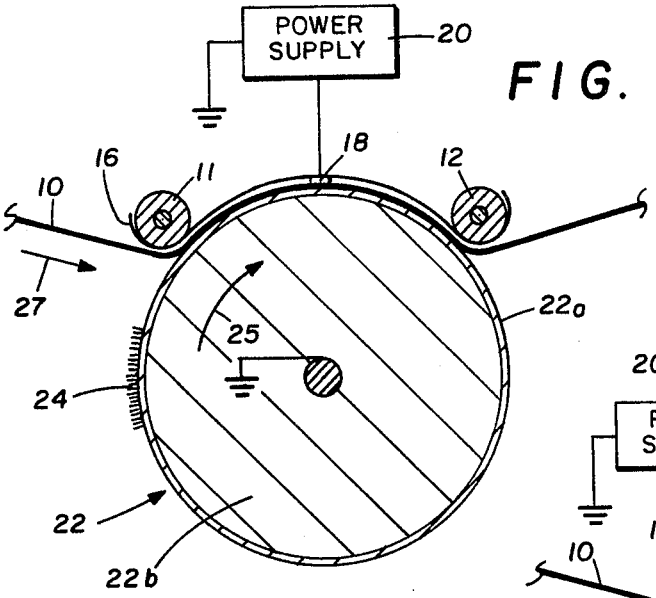
FIG. 1 schematically shows in a side view a transfer system constructed in accordance with the present invention.

Referring now to FIG. 1, there is shown a photoreceptor drum 22 having a photoreceptive surface 22*a* on the drum body 22*b*. In accordance with conventional electrostatic printing techniques, as described in "Electrophotography" by R. M. Schaffert, copyright 1975, published by Focal Press Ltd., a toner image 24 has been deposited on the photoreceptive surface 22*a*.

A dielectric belt 16 made of a flexible material such as MYLAR is stretched between a pair of shaft-like anchoring members, such as rollers 11 and 12, and extends substantially the length of the rollers. The rollers 11 and 12, which extend across substantially the full axial length of the drum 22, are located adjacent to the drum such that the dielectric belt 16 is deflected by the drum 22. A paper web 10 is fed from a storage roll of paper between the roller 11 and the drum 22, under the dielectric belt 16 and out between the roller 12 and the drum 22.

A flexible electrode 18 is attached to the lower surface of the dielectric belt 16 at a transfer station and extends lengthwise of the photoreceptive drum 22 for a distance not exceeding the width of the paper web 10. The electrode 18 contacts the paper web 10 which travels between the dielectric belt 16 and the photoreceptive surface 22*a*, except at the electrode 18. Thus, the electrode 18 is prevented from contacting the drum 22 by the paper web 10. A power supply 20 biases the electrode 18 in relation to an electrostatic charge on the drum 22.

In operation, the toner image 24 is electrostatically deposited on the photoreceptive surface 22*a* using conventional electrostatic printing techniques. The drum 22 rotates in a clockwise direction, as shown by the arrow 25, and the paper web 10 is fed in the direction of the arrow 27 such that the paper travels at the same surface speed as the drum 22. Therefore, there is no relative motion between the web 10 and the drum 22 at the transfer station. The paper web 10 is forced into physical contact with the photoreceptive surface 22*a* by the roller 11, the roller 12 and the dielectric belt 16. The dielectric belt 16 is attached at its ends to rollers 11 and 12, and these rollers are rotated so as to tension the dielectric belt 16, thereby forcing it toward the drum 22, whereby the paper web 10 is forced into contact with the photoreceptive surface 22*a*.

As the drum 22 rotates, the toner image 24 is brought into contact with the paper web 10. The electrode 18 is supplied with a bias potential by the power supply 20, thereby attracting the toner particles 24 away from the drum 22 and transferring them onto the paper web 10. It has been found that a bias potential of 600 volts provides an effective transfer. Preferably, the electrode 18 is formed from a thin brass shim stock or similar flexible, conductive material to avoid excessive electrode-to-paper and paper-to-photoreceptor air gaps axially and circumferentially of the drum 22. It has also been noted that the width of the electrode is not critical with widths of $\frac{1}{8}$ inch to 1 inch having performed with approximately equal effectiveness. Once the toner particles have been transferred to the paper web 10, they are fixed on the paper in accordance with conventional electrostatic printing techniques.

Figure 2:
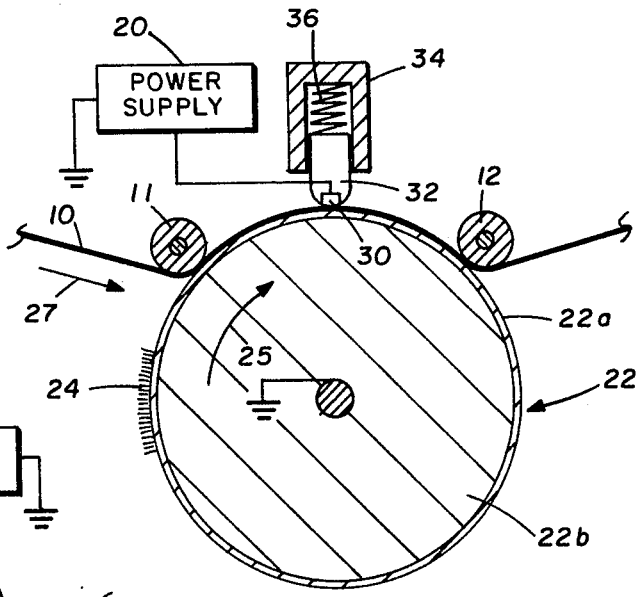
FIG. 2 is a side view of an alternate embodiment of a transfer system constructed in accordance with the present invention.

An alternate form of the present invention is shown in FIG. 2. The dielectric belt 16 and electrode 18 are replaced with a dielectric holder 32 having a flexible electrode 30 extending the length of the dielectric holder. The dielectric holder 32 extends the length of the drum 22 and is mounted in a frame 34 and is urged against the drum 22 by an array of springs 36. The power supply 20 biases the electrode 30 in relation to the photoreceptive drum 22.

The paper web 10 is fed between the roller 11 and drum 22 in the direction of the arrow 27, under the electrode 30 and out between the roller 12 and drum 22. The electrode 30 is biased in the manner described above to transfer the toner image 24 to the paper web 10.

Figure 3:
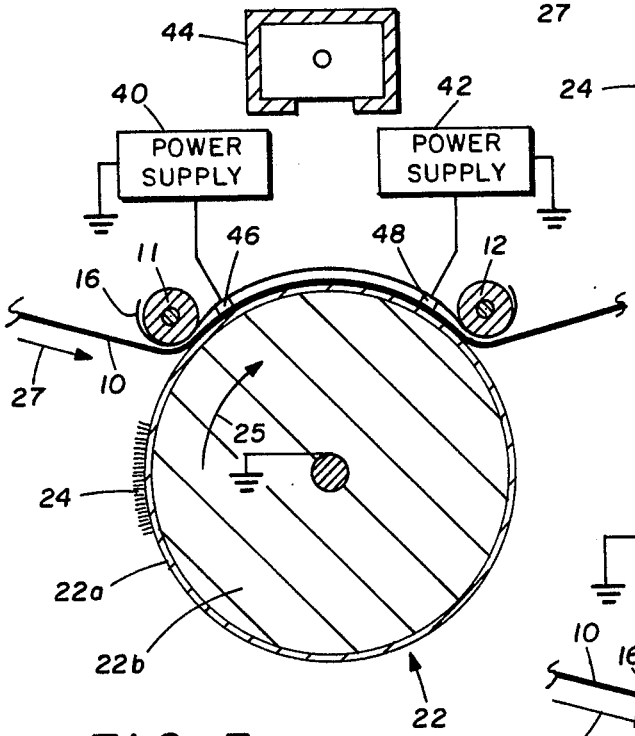
FIG. 3 is a side view of a field control system for use with either of the embodiments of FIGS. 1 and 2.

In FIG. 3 there is shown a field control unit that may be incorporated into the systems of FIGS. 1 and 2 for use with a conventional corotron 44. The field control unit includes a dielectric belt 16 which is tensioned between rollers 11 and 12 in the manner described above. One electrode 46 is attached to the lower face of the dielectric belt 16 adjacent the roller 11 and another electrode 48 is attached to the lower face of the dielectric belt 16 adjacent to the roller 12. Both of those electrodes 46 and 48 are selected to have a length approximately equal to, but not exceeding, the width of the web 10 and to have sufficient flexibility to avoid excessive air gaps as previously described. The paper web 10 is fed under the roller 11 direction of the arrow 27 and under the dielectric web 16 so that it is in physical contact with the photoreceptive surface 22*a*. The paper web 10 slides past the dielectric belt 16 and exits between the roller 12 and the drum 22. The electrodes 46 and 48 are biased by power supplies 40 and 42, respectively, in relation to the drum 22.

The corotron transfer unit 44 provides the electrostatic bias to transfer the toner image 24 from the photoreceptive surface 22 onto the paper web 10.

As the paper web 10 makes contact with the dielectric belt 16 and the photoreceptive surface 22*a* at roller 11, a static electric discharge is possible. In a like manner, a static discharge is possible when the paper web 10 breaks contact with the photoreceptive surface 22*a* at the roller 12. These static discharges can disrupt the operation of the electrostatic printer. Such a discharge can disrupt the charge pattern on the drum surface 22*a*, causing a portion of the pattern to be displaced from its proper location on the drum surface, thereby producing distortion of the image. In addition, the static discharge can affect the electrostatic transfer field, particularly that of a corotron, and cause nonuniform transfer of toner to the paper web, thus degrading the quality of the image.

The electrodes 46 and 48 are electrically biased by the power supplies 40 and 42, respectively, to control the electric fields at the entrance and exit of the transfer station. These electrodes also serve to stabilize the electrostatic fields near the electrodes at a predetermined level. This allows the electrostatic printer to operate at the designed amplitude levels for both the charges on the drum surface 22*a* and the electrostatic field transfer system.

Figure 4:
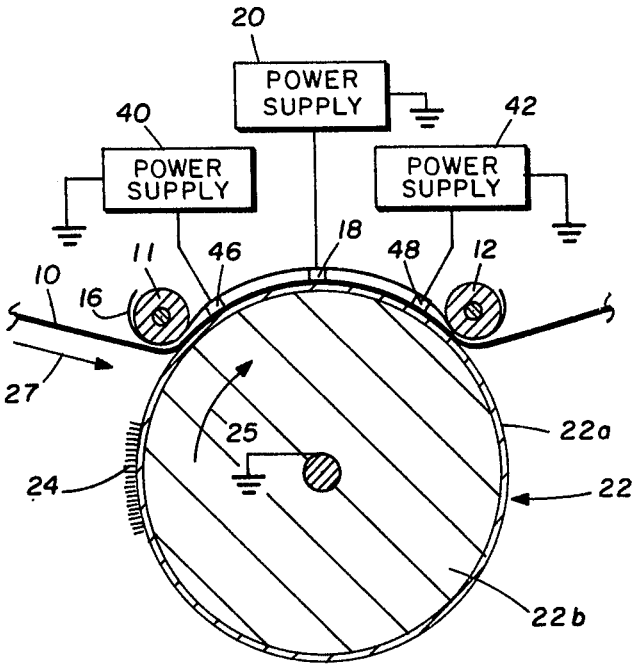
FIG. 4 is a side view of a transfer system having field control electrodes.

In FIG. 4 there is shown a toner transfer system utilizing field control electrodes. The transfer electrode 18 and the field electrodes 46, 48 are positioned and operate as described above.

To produce the electrostatic image, the photoreceptive surface 22*a* is initially charged and then exposed to a negative optical image. Wherever light strikes the photoreceptive surface 22*a*, the toner 24 is then applied to the photoreceptive surface 22*a* to form the physical image in the discharged areas. Field control is provided by the electrodes 46 and 48 as described above. That is, the electrodes 46 and 48 are biased to suppress the extraneous static discharges which tend to occur along the leading and trailing edges of the paper web/-photoreceptor contact zone — viz., the transfer zone.

Although several embodiments of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

What is claimed is:

1. In a transfer system for transferring electrostatically charged toner particles from an imaging surface of an electrostatographic printer to a paper web; the improvement comprising a. a flexible, solid electrode extending widthwise of said web;

b. dielectric means for supporting said electrode in sliding contact with one side of said web and for maintaining an opposite side of said web in contact with said imaging surface throughout a predetermined zone; and c. means for electrically biasing said electrode relative to said imaging surface, whereby toner particles transfer from said imaging surface to said web.

2. The improvement of claim 1 wherein said dielectric means is a belt extending laterally from opposite edges of said electrode to maintain said web in contact with said imaging surface throughout an elongated zone.

3. The improvement of claim 2 further including:

a. a second flexible electrode and a third flexible electrode extending widthwise of said web on the side of said web opposite from said imaging surface and substantially in line with a lead edge and a trail edge, respectively, of said elongated zone;

b. means for holding said second and third electrodes against said web; and c. means for electrically biasing said second and third electrodes relative to said imaging surface to suppress static discharges proximate said leading and trailing edges.

4. The improvement of claim 1 wherein said dielectric means is a spring biased holder for said electrode.

5. The improvement of claim 2 further including a pair of anchoring members joined to opposite ends of said belt for tensioning said belt against said paper web.

6. An electrostatic printer as recited in claim 5 including:

a. a second electrode and a third electrode extending widthwise of said web on the side of said web opposite from said imaging surface and substantially in line with a lead edge and a trail edge, respectively, of said zone;

b. means for holding said second and third electrodes against said web; and c. means for electrically biasing said second and third electrodes relative to said imaging surface to suppress static discharges proximate said leading and trailing edges.

7. An electrostatic printer of the type having a drum with a photoconductive imaging surface for carrying electrostatically charged toner particles in an image configuration; said printer comprising a. means for transferring said toner from said imaging surface to a paper web within a predetermined transfer zone;

b. first and second spaced apart flexible electrodes extending axially of said drum on a side of said web opposite from said imaging surface and substantially in line with a lead edge and a trail edge, respectively, of said transfer zone;

c. means for supporting said electrodes in contact with said web; and d. means for electrically biasing said electrodes relative to said drum to provide static discharge suppression.

8. An electrostatic printer as recited in claim 7 wherein said means for supporting said electrodes is a dielectric belt.

9. An electrostatic printer as recited in claim 8 including a pair of anchoring shafts having axes substantially parallel to the axis of said drum, said shafts being joined to opposite ends of said belt for tensioning said belt between said shafts and against said web.

10. An electrostatic printer as recited in claim 9 wherein said shafts are positioned to maintain said web in contact with said imaging surface throughout a zone spanning the space between said electrodes.

11. An electrostatic printer including a drum having a photoconductive imaging surface for carrying an image-like pattern of electrostatically charged toner particles, and a transfer system for transferring said toner particles from said imaging surface to a paper web; said transfer system comprising a. a first flexible electrode extending axially of said drum on a side of said web opposite from said drum;

b. a second flexible electrode extending axially of said drum on a side of said web opposite from said drum and proximate a line along which said web initially engages said imaging surface;

c. a third flexible electrode extending axially of said drum on a side of said web opposite from said drum and proximate a line along which said web disengages from said imaging surface;

d. means for electrically biasing said first electrode to transfer said toner from said imaging surface to said web;

e. means for electrically biasing said second and said third electrodes relative to said drum to suppress spurious static discharges;

f. a flexible dielectric belt for supporting said electrodes in contact with said paper web; and g. a pair of anchoring shafts having axes substantially parallel to the axis of said drum, each of said shafts being joined to an opposite end of said dielectric belt for tensioning said belt between said shafts and against said web.

* * * * *